US009358585B2

(12) United States Patent
Nilson

(10) Patent No.: US 9,358,585 B2
(45) Date of Patent: Jun. 7, 2016

(54) AGRICULTURAL ARTICLE SIZER

(71) Applicant: Crary Industries, Inc., West Fargo, ND (US)

(72) Inventor: Michael A. Nilson, West Fargo, ND (US)

(73) Assignee: Crary Industries, Inc., West Fargo, ND (US)

( * ) Notice: Subject to any disclaimer, the term of this patent is extended or adjusted under 35 U.S.C. 154(b) by 12 days.

(21) Appl. No.: 14/155,597

(22) Filed: Jan. 15, 2014

(65) Prior Publication Data

US 2014/0197081 A1 Jul. 17, 2014

Related U.S. Application Data

(60) Provisional application No. 61/753,065, filed on Jan. 16, 2013.

(51) Int. Cl.

| | |
|---|---|
| ***B07B 13/00*** | (2006.01) |
| ***B07C 5/12*** | (2006.01) |
| ***B07B 13/075*** | (2006.01) |
| ***B07B 13/04*** | (2006.01) |
| ***B07B 13/07*** | (2006.01) |
| ***B07B 1/14*** | (2006.01) |
| ***B07B 1/46*** | (2006.01) |

(52) U.S. Cl.

CPC ..... *B07B 13/075* (2013.01); *B07B 1/14* (2013.01); *B07B 1/4636* (2013.01); *B07B 13/04* (2013.01); *B07B 13/07* (2013.01); *B07B 13/072* (2013.01)

(58) Field of Classification Search

CPC ..... B65H 13/00; B65H 13/003; B65H 13/04; B65H 13/07; B65H 13/072; B65H 13/075; B65H 1/14; B65H 1/4636; B65H 1/16

USPC ..... 209/621, 632, 659, 660, 662, 667, 668, 209/673, 676

See application file for complete search history.

(56) References Cited

U.S. PATENT DOCUMENTS

| | | | | | |
|---|---|---|---|---|---|
| 3,545,612 | A * | 12/1970 | Mumma | B07B 13/075 | 209/622 |
| 4,627,541 | A * | 12/1986 | Johnson | B07B 1/14 | 209/394 |
| 4,763,794 | A * | 8/1988 | Billington, III | B07B 1/50 | 209/379 |
| 4,903,845 | A * | 2/1990 | Artiano | D21B 1/023 | 209/671 |
| 6,234,322 | B1 * | 5/2001 | Paladin | B07B 1/15 | 209/517 |
| 6,454,101 | B1 * | 9/2002 | Doornekamp | A01K 43/00 | 198/779 |

(Continued)

FOREIGN PATENT DOCUMENTS

| | | | | |
|---|---|---|---|---|
| GB | 2222787 | A * | 3/1990 | B07B 1/10 |

*Primary Examiner* — Prasad Gokhale

(74) *Attorney, Agent, or Firm* — Wood, Phillips, Katz, Clark & Mortimer

(57) ABSTRACT

An agricultural article sizer with a frame assembly and a plurality of elongate rollers on the frame assembly with substantially parallel lengthwise axes and through which agricultural articles are advanced and separated by size. First and second of the rollers have first and second axes and first and second peripheral surfaces. A third roller has a third peripheral surface and a third axis between the first and second axes along a conveying direction. The third roller is movable selectively relative to the first roller to change a spacing between the third axis and a plane containing the first and second axes to thereby change a dimension of a gap between the first and third peripheral surfaces to thereby allow passage through the gap of different selected ranges of agricultural article size.

23 Claims, 9 Drawing Sheets

(56) References Cited

U.S. PATENT DOCUMENTS 6,547,079 B2 * 4/2003 Sardo ..... B07B 13/075 209/626

6,726,028 B2 * 4/2004 Visscher ..... B07B 1/14 209/668

2006/0113224 A1 * 6/2006 Williamson ..... B07B 13/04 209/615

* cited by examiner

AGRICULTURAL ARTICLE SIZER

BACKGROUND OF THE INVENTION

1. Field of the Invention

This invention relates to agricultural equipment and, more particularly, to a system through which agricultural articles can be sorted based upon size.

2. Background Art

A multitude of systems have been devised to sort agricultural articles, such as potatoes, by size. Typically, stages are built into these systems with gaps of different size to pass potatoes within different size ranges. Commonly, with potatoes, small potatoes of less than 1.5 inch nominal diameter are separated in one stage, with seed cut size potatoes, on the order of 1.5 to 2.0 inch nominal diameter, separated in another stage. A third stage may be provided to accumulate potatoes of nominal diameter greater than 2 inches.

It is known to use elongate rollers between which gaps of different size are formed. Gap adjustment capability is desirable to provide a system with versatility in terms of sorting different ranges of product diameter.

At the same time, these systems must be reliable in operation and not prone to jamming as might necessitate system downtime that could significantly financially impact operations.

The industry continues to seek sizer systems that are effective, reliable in operation, and financially feasible so as to make investment in this type of system practical as an alternative to systems that are more manually controlled.

SUMMARY OF THE INVENTION

In one form, the invention is directed to an agricultural article sizer with a frame assembly and a plurality of elongate rollers on the frame assembly with substantially parallel lengthwise axes and through which agricultural articles are: a) advanced in a conveying direction transverse to the roller axes; and b) separated by size. First and second of the rollers have first and second axes and first and second peripheral surfaces. A third roller has a third peripheral surface and a third axis between the first and second axes along the conveying direction. The third roller is movable selectively relative to the first roller to change a spacing between the third axis and a plane containing the first and second axes to thereby change a dimension of a gap between the first and third peripheral surfaces to thereby allow passage through the gap of different selected ranges of agricultural article size.

In one form, the plurality of rollers is driven in an endless path.

In one form, the third roller is movable to be in a first relationship with the first roller wherein the gap between the first and third peripheral surfaces has a first dimension to allow passage through the gap of agricultural articles less than or equal to a first size to a first collection location.

In one form, there is a first conveying assembly for directing agricultural articles passing through the gap to the first collection location transversely to the conveying direction to a first point of use.

In one form, the third roller is movable to be in a second relationship with the first roller wherein the gap between the first and third peripheral surfaces has a second dimension that is greater than the first dimension to allow passage through the gap of agricultural articles less than or equal to a second size that is greater than the first size.

In one form, the agricultural article sizer has an upper article conveying length with an upstream end and a downstream end. The agricultural article sizer further includes a roller guide system. The roller guide system cooperates with the plurality of rollers to cause the third roller to move from the first relationship with the first roller into the second relationship with the first roller as an incident of the third roller moving in the conveying direction towards the downstream end of the article conveyor length.

In one form, with the third roller in the second relationship with the first roller, articles less than or equal to the second size pass through the gap to a second collection location downstream of the first collection location.

In one form, there is a conveying assembly for directing agricultural articles passing through the gap to the second location transversely to the conveying direction to a second point of use.

In one form, the agricultural article sizer has an endless chain and a drive for advancing the chain in an endless path. The plurality of rollers is connected to the endless chain to follow movement of the endless chain in the endless path.

In one form, the first, second, and third rollers each has axially spaced first and second ends. The roller guide system further has a first bracket to which the first ends of the third roller and one of the first and second rollers is connected. The first end of the one of the first and second rollers is connected to the first bracket so that the axis of the one of the first and second rollers is fixed relative to the first bracket. The first bracket has a first elongate slot within which the first end of the third roller is guidingly movable to allow the third roller to change between the first and second relationships with the first roller.

In one form, the first elongate slot is substantially straight and extends vertically with the third roller located along the upper article conveying length.

In one form, the roller guide system further includes a wheel at the first end of the third roller and a guide surface extending in the conveying direction. The wheel rolls against the guide surface as the rollers are advanced in the conveying direction. The guide surface is configured so that as the wheel rolls against the guide surface, the third roller is caused to change between the first and second relationships with the first roller.

In one form, the guide surface is configured to be reoriented to thereby change a travel path for the wheel as the chain moves in the endless path.

In one form, there is a conveying assembly that receives agricultural articles that do not pass between rollers between the upstream and downstream ends of the upper article conveying length and that discharge at the downstream end of the upper article conveying length and directs the discharging articles to a third point of use.

In one form, with the third roller in the first relationship with the first roller, the third axis is at, or closely adjacent to, the plane containing the first and second axes.

In one form, the first, second, and third peripheral surfaces of the rollers have diameters that are substantially the same.

In one form, the first conveying assembly has a conveying component with a surface that is driven in an endless path.

In one form, the roller guide system includes a wheel at the first end of each of the first and second rollers and a guide surface extending in the conveying direction against which the wheels on the first and second rollers roll as the rollers are advanced in the conveying direction.

In one form, the agricultural article sizer further includes a second bracket to which the other of the first and second rollers is connected. The first and second brackets are movable independently, each from the other.

In one form, there is at least one repositionable flap that confines articles upon the rollers. The third roller acts against the at least one repositionable flap and repositions the flap as an incident of the third roller moving relative to the first roller to change the spacing between the third axis and the plane containing the first and second axes.

DETAILED DESCRIPTION OF THE PREFERRED EMBODIMENT

Figure 1:
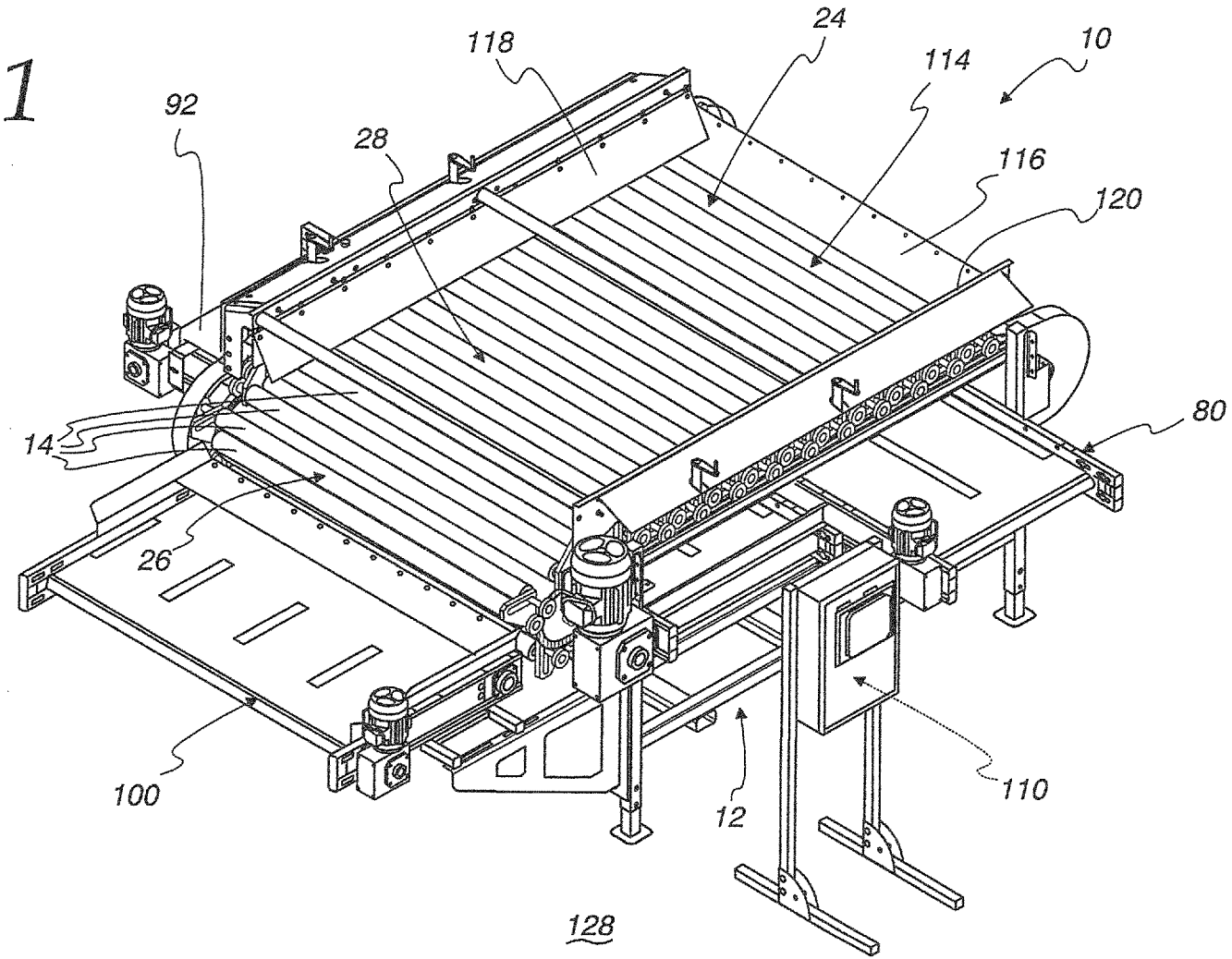
FIG. 1 is a perspective view of an agricultural article sizer, according to the present invention.
Figure 2:
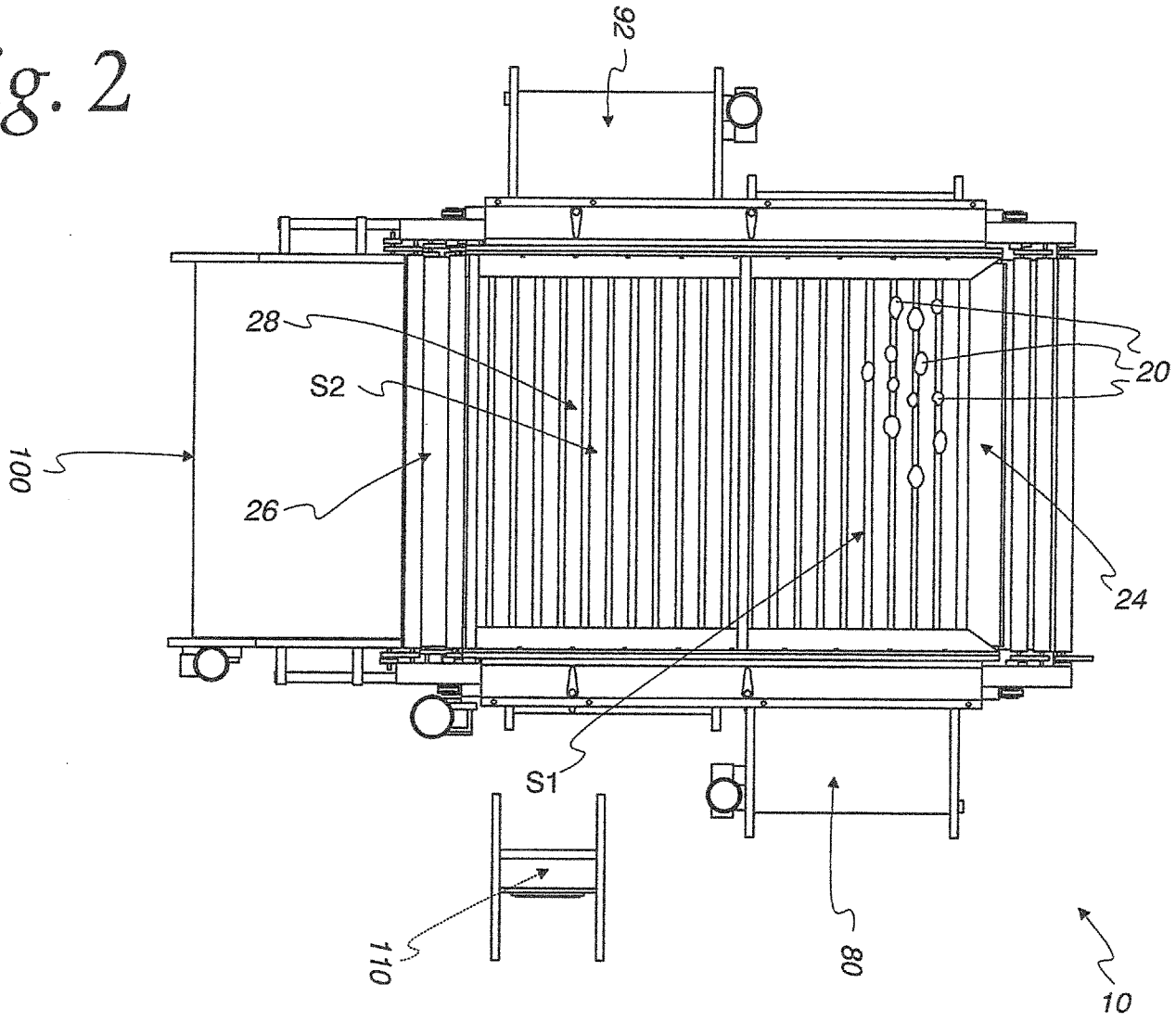
FIG. 2 is a plan view of the sizer in FIG. 1.
Figure 3:
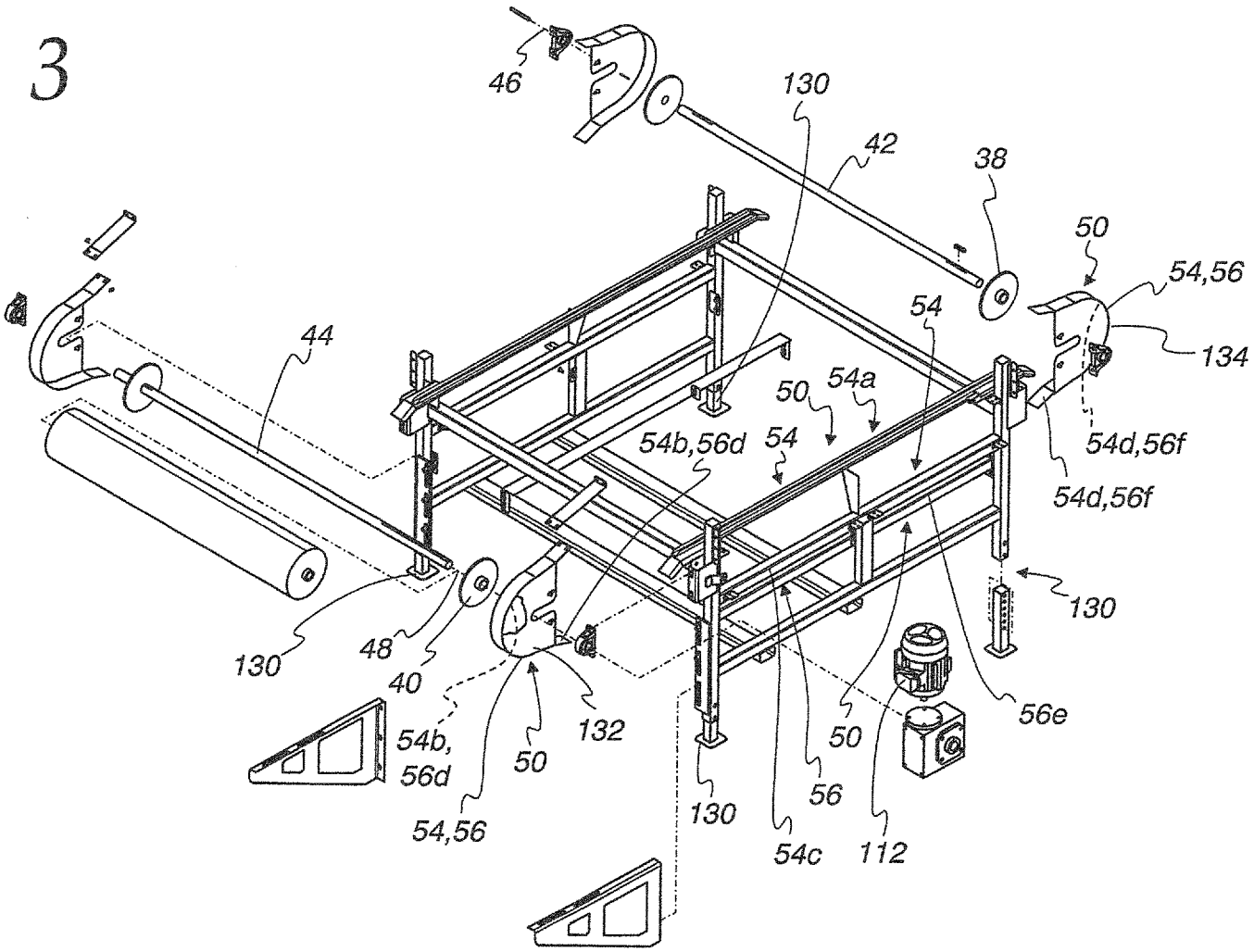
FIG. 3 is a reduced, exploded, perspective view of the sizer in FIGS. 1 and 2 with certain components removed.
Figure 4:
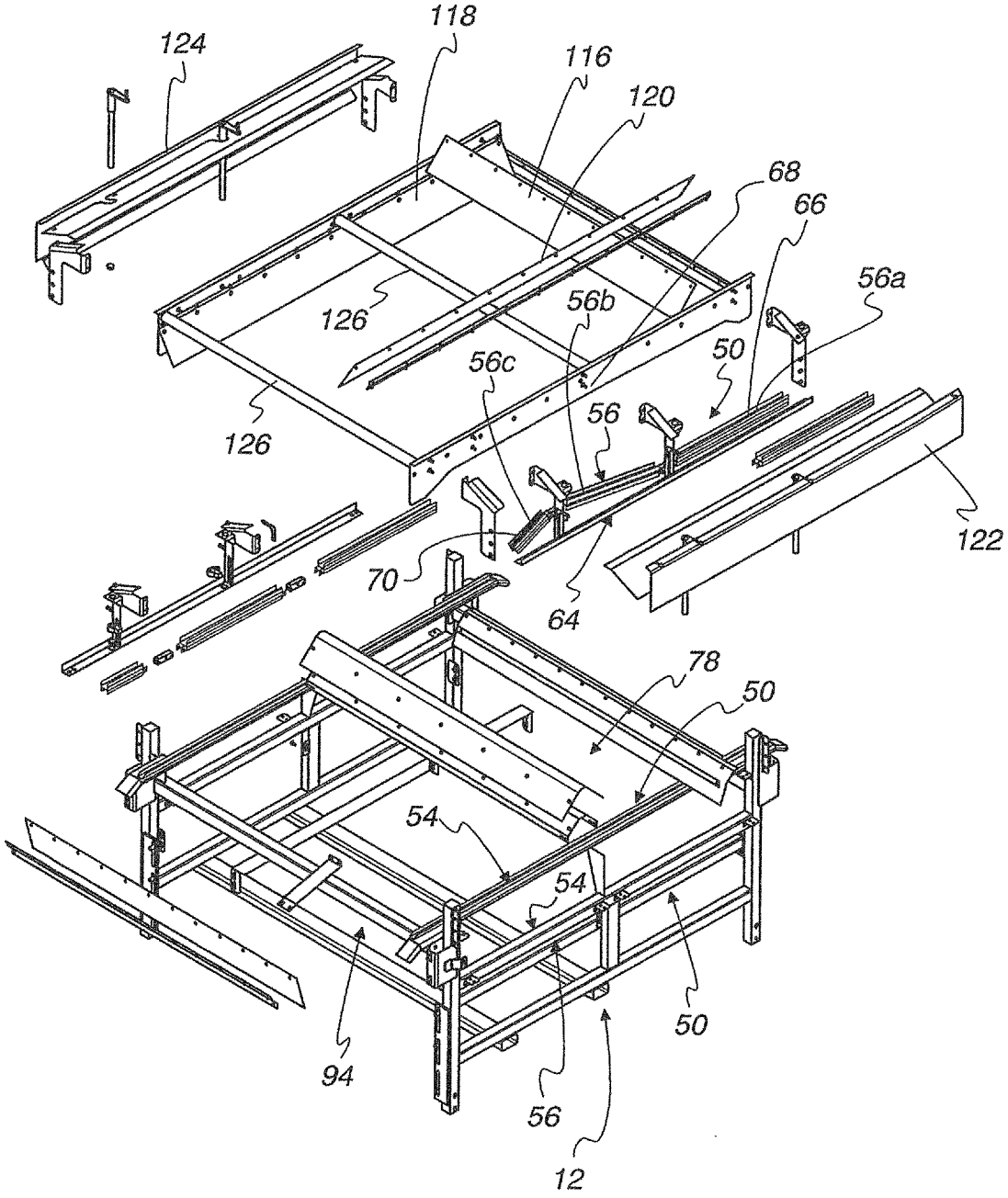
FIG. 4 is a view as in FIG. 3 with different components removed.
Figure 5:
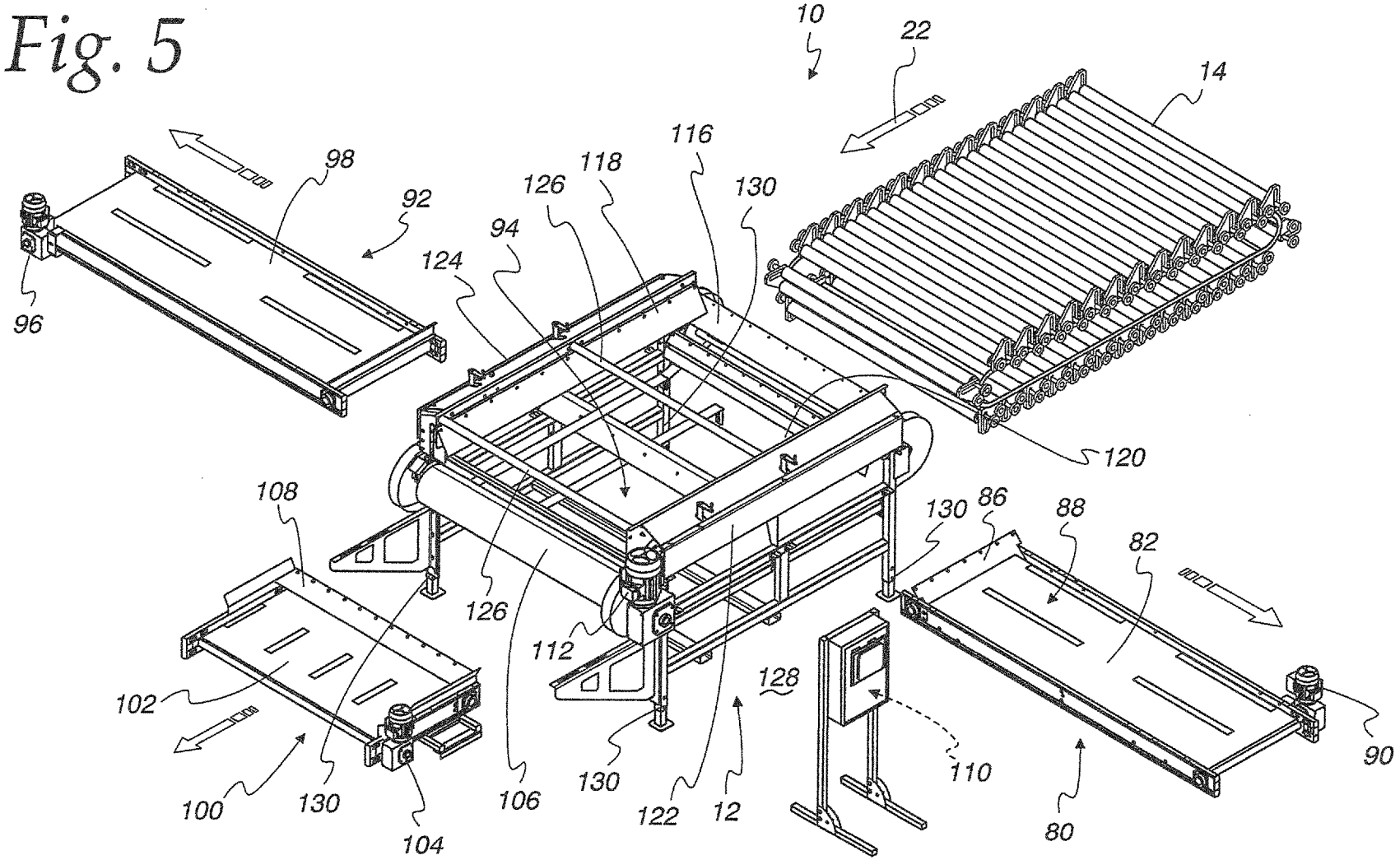
FIG. 5 is a reduced, exploded, perspective view of the sizer in FIGS. 1 and 2.
Figure 6:
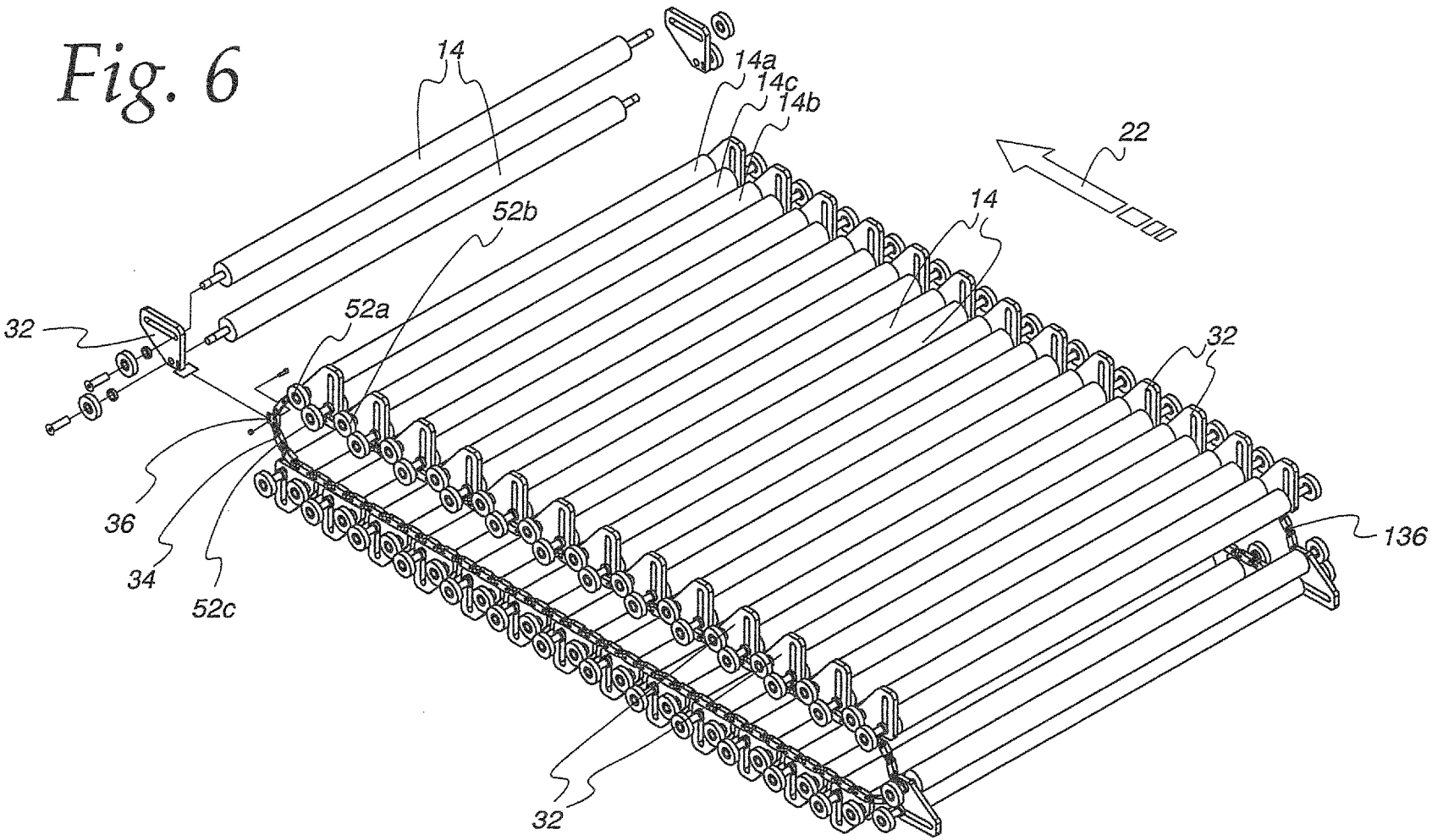
FIG. 6 is an enlarged, partially exploded, perspective view of rollers on the sizer used to advance articles and define variable gaps through which articles pass for sorting.
Figure 7:
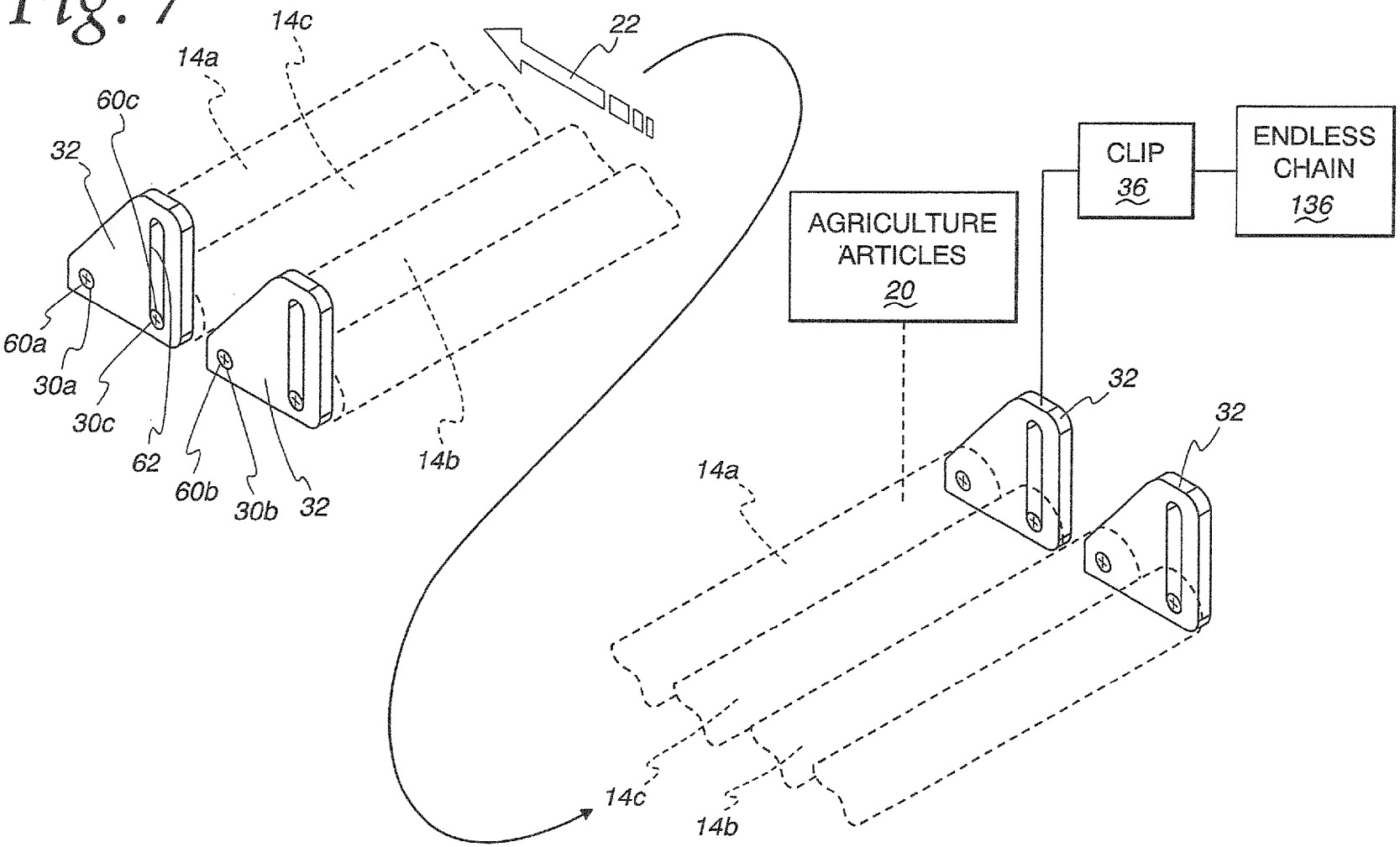
FIG. 7 is an enlarged, partially schematic, fragmentary, perspective view of a plurality of the rollers supported on brackets.

Referring to FIGS. 1-10, an agricultural article sizer, according to the present invention, is shown at 10. The sizer 10 consists of a frame assembly at 12 that supports a plurality of elongate rollers 14. The elongate rollers 14 cooperate effectively in groups of three with first and second rollers 14*a*, 14*b*, respectively having first and second axes 16*a*, 16*b*, and a third roller 14*c* with a third axis 16*c*. The axes 16*a*, 16*b*, 16*c* are substantially parallel to each other.

The first, second, and third rollers 14*a*, 14*b*, 14*c* have peripheral surfaces 18*a*, 18*b*, 18*c*, successively. Through the rollers 14*a*, 14*b*, 14*c*, agricultural articles 20, which may be potatoes, or the like, are advanced in a conveying direction, transverse to the roller axes 16*a*, 16*b*, 16*c*, as indicated by the arrow 22, between an upstream end 24 and a downstream end 26 of an upper conveying length at 28. Through the rollers 14*a*, 14*b*, 14*c*, the agricultural articles 20 are separated by size/nominal diameter.

The rollers 14*a*, 14*b*, 14*c* have spaced axial ends that are connected to the frame assembly 12 at spaced locations in like fashion. The rollers 14 cooperate with the frame assembly 12 through the same structure at the opposite axial ends thereof during operation. The description herein will be limited to the connection of one exemplary axial end 30*a*, 30*b*, 30*c*, for the first, second, and third rollers 14*a*, 14*b*, 14*c*, successively. Also, it should be pointed out that the cooperation of the first, second, and third rollers 14*a*, 14*b*, 14*c* is described at one location. For the next adjacent cooperating pair of three rollers, the second roller 14*b* would correspond to the first roller 14*a*.

Each of the roller ends 30*a*, 30*b*, 30*c* is supported on a bracket 32 with a fixed shape, with the first and third rollers 14*a*, 14*c* mounted on an upstream bracket 32 and the second roller 14*b* mounted on a following bracket 32 that moves independently of the upstream bracket 32. All of the brackets 32 are mounted on an endless chain 34, each through a separate clip 36 that allows the brackets 32 to pivot relative to the chain 34 as it moves in its endless path.

The chain 34 is trained around separate sprockets 38, 40, respectively mounted to idler and driven shafts 42, 44. The shafts 42, 44 are suitably mounted to turn around spaced, parallel axes 46, 48, respectively.

While the rollers 14*a*, 14*b*, 14*c* are driven by the endless chain 34 in an endless path, the rollers 14*a*, 14*b*, 14*c* are stabilized and guided positively as they move through this path by a guide system at 50 that cooperates with wheels 52*a*, 52*b*, 52*c*, successively at the axial ends 30*a*, 30*b*, 30*c* of the rollers 14*a*, 14*b*, 14*c*. More specifically, the guide system 50 consists of a guide surface arrangement 54 that cooperates with the first and second wheels 52*a*, 52*b* and a separate guide surface arrangement 56 that cooperates with the wheel 52*c*. The guide surface arrangements 54, 56 define wheel tracks that are offset axially from each other.

The guide surface arrangement 54 consists of guide surface portions 54*a*, 54*b*, 54*c*, 54*d* that guide the wheels 52*a*, 52*b* in a predetermined elliptical path. As the wheels 52*a*, 52*b* act against the guide surface arrangement 54, the rollers 14*a*, 14*b* rotate about their respective axes 16*a*, 16*b* in the direction of the arrows 58*a*, 58*b*. The axes 16*a*, 16*b* of the rollers 14*a*, 14*b* are fixed with respect to their respective bracket 32. More specifically, shafts 60*a*, 60*b*, associated with the rollers 14*a*, 14*b* are journaled for rotation with respect to their respective brackets 32 to thereby guide movement of the rollers 14*a*, 14*b* around their axes 16*a*, 16*b*.

Figure 10:
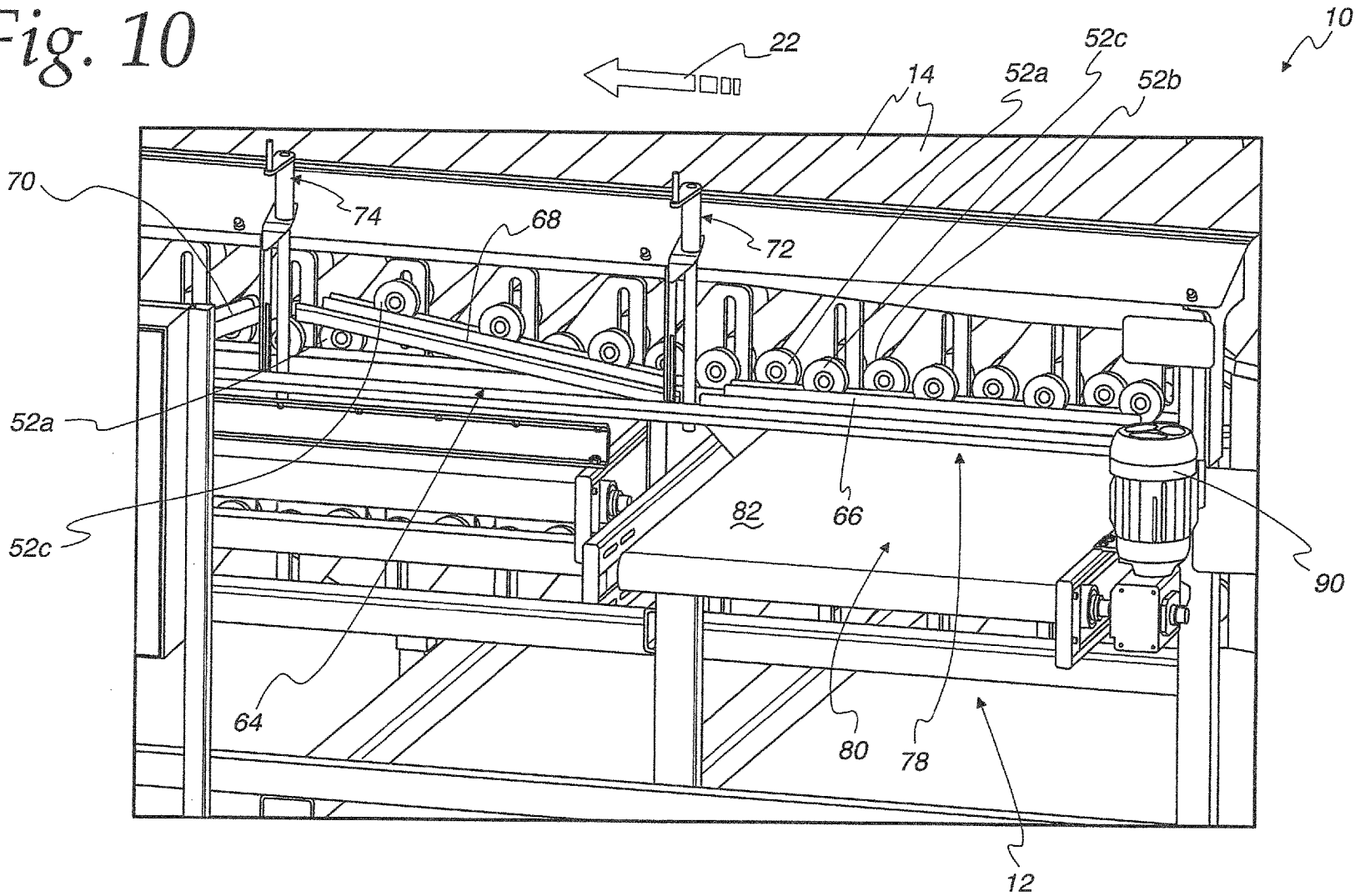
FIG. 10 is an enlarged, fragmentary, perspective view of the sizer in FIGS. 1 and 2.

A shaft 60*c* on the roller 14*c* is received in an elongate slot 62 in the bracket 32 that supports the shaft 60*a*. With this arrangement, the roller 14*c* is guided in translation relative to its associated bracket 32 in a vertical direction, with the bracket 32 traversing the upper article conveying length. Controlled movement of the roller 14*c* is effected by the interaction of the wheel 52*c* and guide surface portions 56*a*, 56*b*, 56*c*, 56*d*, 56*e*, 56*f* on the guide surface arrangement 56. More specifically, the guide surface arrangement 56 consists of a reconfigurable guide surface length at 64 made up of three movable sections 66, 68, 70. Through crank handles 72, 74, which in this case are manually operable, the inclination primarily of the section 68 is changed. As depicted in FIG. 10, with the section 68 reoriented to be inclined upwardly in a downstream direction, the wheel 52*c* rolling thereagainst will advance progressively upwardly in a re-defined travel path while the wheels 52*a*, 52*b* continue their horizontal travel in their associated track.

Figure 8:
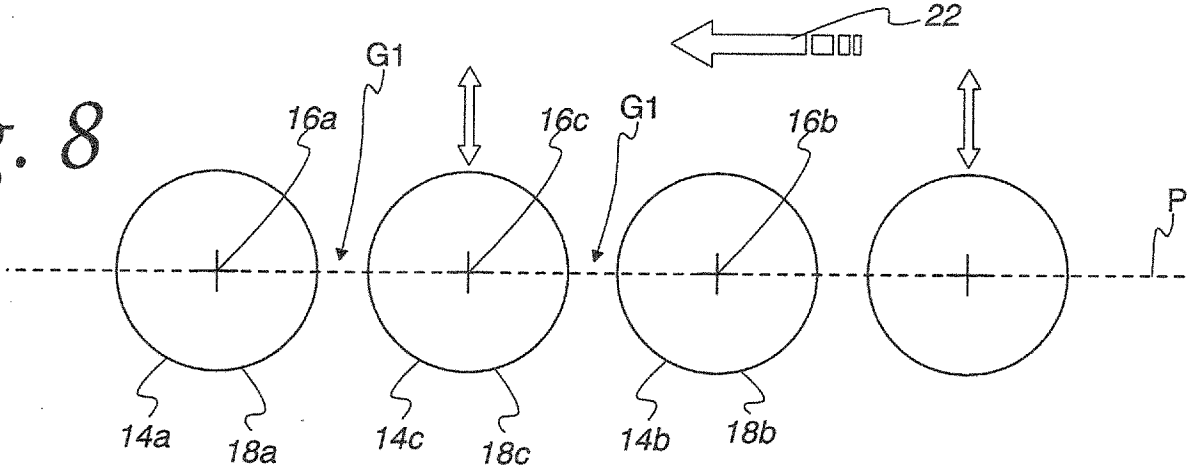
FIG. 8 is a schematic representation of rollers on the sizer in one relationship that produces gaps of a first size.

Leading up to the section 68, the axes 16*a*, 16*b*, 16*c* of the rollers 14*a*, 14*b*, 14*c* reside in substantially the same horizontal plane P over a first, upstream stage S1 of the article conveying length, as shown clearly in FIG. 8. The axis 16*c* may alternatively be adjacent to the plane P. With this arrangement, and the third roller 14*c* in a first relationship with the first and second rollers 14*a*, 14*b*, gaps G1 are defined between the rollers 14*a*, 14*c* and 14*b*, 14*c*. In the depicted embodiment, the peripheral surfaces 18*a*, 18*b*, 18*c* have the same diameters. With the axes 16*a*, 16*b*, 16*c* spaced equidistantly from each other, the gaps G1 will have a dimension that will allow passage therethrough of agricultural articles of a first nominal diameter/size.

Figure 9:
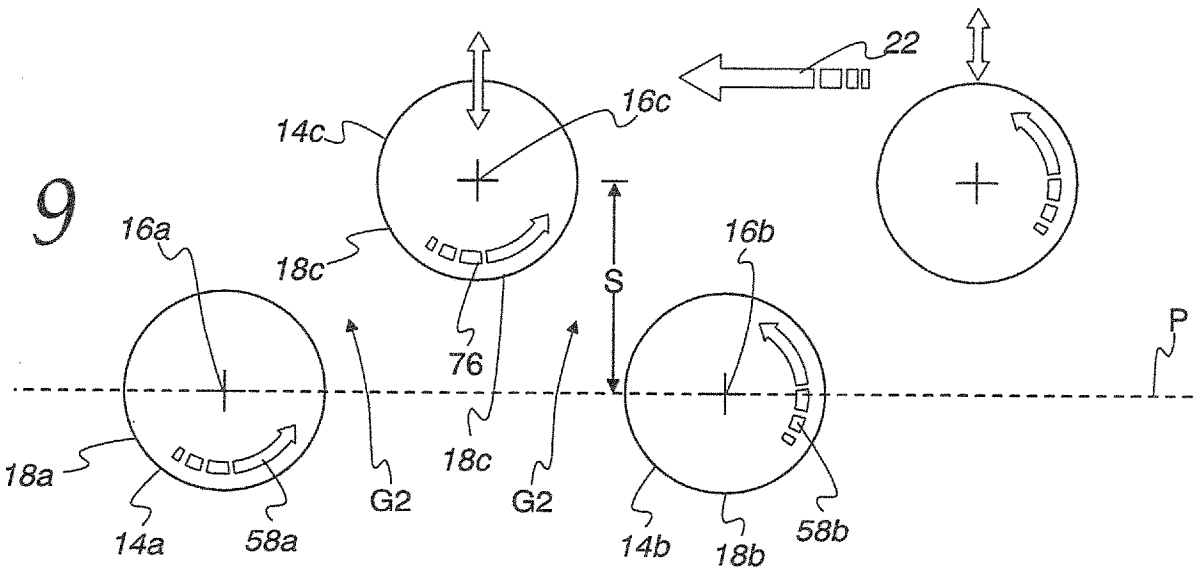
FIG. 9 is a view as in FIG. 8 wherein the rollers have been relatively repositioned to produce gaps of a larger size.

As the wheel 52*c* moves in the track section 68, as seen in FIG. 9, a spacing S is developed between the axis 16*c* of the third roller 14*c* and the plane P that contains the axes 16*a*, 16*b* of the rollers 14*a*, 14*b*. As a result, with the third roller in a second relationship with the first and second rollers 14*a*, 14*b*, a gap 02 is formed between the third roller 14*c* and each of the first and second rollers 14*a*, 14*b* that is larger than the gap G1. During this transition, the roller 14*c* rotates in the direction of the arrow 76 about its axis 16*c*.

Accordingly, with the larger gap G2, agricultural articles with a larger diameter than would pass through the gap G1 are capable of passing between the rollers 16*a*, 16*c* and 16*b*, 16*c* at a second, downstream stage S2 where the gap G2 is maintained.

The first upstream stage S1 where the axes 16*a*, 16*b*, 16*c* reside in the same plane P along the upper conveying length, the gap G1 can be chosen to allow passage therethrough of agricultural articles 20 having a first size range up to a first nominal diameter.

By controlling the spacing S between the axis 16*c* and the plane P containing the axes 16*a*, 16*b* through operation of the crank handles 72, 74, the gap G2 can be controlled to allow passage therethrough of agricultural articles 20 larger than the first nominal diameter and in a range up to a second nominal diameter determined based upon the degree of the spacing S.

While not depicted, it is possible to have a third stage with another gap sized to allow controlled sorting of agricultural articles with a third range of diameters.

Agricultural articles that do not pass between rollers 14 between the upstream and downstream ends 24, 26 of the upper article conveying length 28 are discharged at the downstream end 26.

Agricultural articles passing through the gap G1 pass to a first collection location at 78 where they are intercepted by a first conveying assembly at 80. The conveying assembly 80 has an endless component 82 that is advanced to direct agricultural articles arriving at the first collection location 78 transversely to the conveying direction for the articles effected by the rollers 14*a*, 14*b*, 14*c*. An inclined shield 86 confines articles to the upper region 88 of the endless component 82. The endless component 82 is operated by an appropriate drive 90.

A second conveying assembly 92 is constructed substantially the same as the first conveying assembly 80. The second conveying assembly 92 intercepts articles passing through the gap G2 at the second stage S2 to a second collection location at 94. A drive 96 moves an endless component 98 so as to advance intercepted agricultural articles from the other side of the sizer 10 in a direction opposite to which the articles are conveyed by the first conveying assembly 80.

A third conveying assembly 100 intercepts articles that do not pass between the rollers 14*a*, 14*b*, 14*c* between the upstream and downstream ends 24, 26 and that discharge at the downstream end 26 of the upper article conveying length 28. The conveying assembly 100 has an endless component 102 operated by a drive 104 to advance intercepted articles in a direction generally parallel to the primary conveying direction between the upstream and downstream ends 24, 26. A drum 106 guides articles discharging at the downstream end 26 onto the component 102. An angled shield 108 performs a guiding function for the articles in conjunction with the drum 106.

Each of the conveying assemblies 80, 92, 100 can advance articles to an appropriate point of use, which may be a collection area, staging area, or an intermediate component integrated into a further conveying arrangement.

A central controller 110 can be programmed to coordinate operation of the various electrical components in the system, including the drives 90, 96, 104, and a drive 112 for the rollers 14*a*, 14*b*, 14*c*. All drives may utilize gear boxes, electric motors, and variable frequency drives controlled preferably through the central controller 110. The use of variable frequency drives allows for infinite speed control of all drives to reduce product movement and reduce possibility of product damage.

A product receiving region at 114, above the upper article conveying length, is defined by a series of inclined flaps/walls 116, 118, 120. The flap 116 is located at the upstream end and is inclined to guide introduced articles to against the rollers 14*a*, 14*b*, 14*c*.

The flaps 118, 120 perform the same function at the sides of the unit. Each of the flaps 118, 120 is constructed so that it is repositionable in response to upward movement of the third rollers 14*c* as an incident of the third rollers 14*c* moving relative to the first roller 14*a* to change the spacing between the third roller axis 16*c* and the plane P containing the first and second roller axes 16*a*, 16*b*.

The frame assembly 12 has spaced side walls 122, 124 that project upwardly to bound an article receiving volume above the conveying length 28. Elongate rods 126 extend between and reinforce the side walls 122, 124. The flaps/walls 118, 120 are connected one each to the side walls 122, 124.

The frame assembly 12 is supported in an elevated position on a subjacent surface 128 by vertically adjustable legs 130 at each of four corners of the frame assembly 12. The adjustment capability allows the plane of the conveying length 28 to be leveled on uneven terrain.

In this embodiment, the frame assembly 12 utilizes spaced shrouds 132, 134 that perform the functions of both shielding the sprockets 38, 40 and defining the guide surface portions 54*b*, 54*d*, 56*d*, 56*f*.

It should be understood that the precise manner for defining the guide tracks is not limited to the specific configuration shown. Virtually an unlimited number of different arrangements can be provided to shift the rollers 14*c* vertically in a controlled manner to change sizing gap size.

As noted above, substantially all of the components at the one side of the article sizer 10 have like components on the other side that are constructed and operate in the same manner.

In this embodiment, a single drive, in this case drive 112, can be used at one side of the sizer 10 to drive the endless chain 34 and a corresponding chain 136 on the opposite side.

The foregoing disclosure of specific embodiments is intended to be illustrative of the broad concepts comprehended by the invention.

The invention claimed is:

1. An agricultural article sizer comprising:

a frame assembly; and a plurality of rollers on the frame assembly with substantially parallel lengthwise axes and through which agricultural articles are: a) advanced in a conveying direction transverse to the roller axes; and b) separated by size, the plurality of rollers comprising first and second rollers with first and second axes and first and second peripheral surfaces and a third roller with a third peripheral surface and a third axis between the first and second axes along the conveying direction, the third roller movable selectively relative to the first roller to change a spacing between the third axis and a plane containing the first and second axes to thereby change a dimension of a gap between the first and third peripheral surfaces to thereby allow passage through the gap of different selected ranges of agricultural article size to facilitate sorting of different sizes of agricultural articles, wherein the first, second, and third rollers each has axially spaced first and second ends, wherein the agricultural article sizer further comprises a first bracket to which the first ends of the third roller and only one of the first and second rollers are directly connected.

2. The agricultural article sizer according to claim 1 wherein the plurality of rollers are driven in an endless path.

3. The agricultural article sizer according to claim 1 wherein the third roller is movable to be in a first relationship with the first roller wherein the gap between the first and third peripheral surfaces has a first dimension to allow passage through the gap of agricultural articles less than or equal to a first size to a first collection location.

4. The agricultural article sizer according to claim 3 wherein the agricultural article sizer is configured to direct agricultural articles passing through the gap to the first collection location transversely to the conveying direction to a point of use.

5. The agricultural article sizer according to claim 4 wherein the agricultural article sizer comprises a conveying component with a surface that is driven in an endless path to direct agricultural articles passing through the gap to the first collection location to the point of use.

6. The agricultural article sizer according to claim 3 wherein the third roller is movable to be in a second relationship with the first roller wherein the gap between the first and third peripheral surfaces has a second dimension that is greater than the first dimension to allow passage through the gap of agricultural articles less than or equal to a second size that is greater than the first size.

7. The agricultural article sizer according to claim 6 wherein the agricultural article sizer has an upper article conveying length with an upstream end and a downstream end and further comprises a roller guide system, the roller guide system cooperating with the plurality of rollers to cause the third roller to move from the first relationship with the first roller into the second relationship with the first roller as an incident of the third roller moving in the conveying direction towards the downstream end of the article conveyor length.

8. The agricultural article sizer according to claim 7 wherein with the third roller in the second relationship with the first roller, articles less than or equal to the second size pass through the gap to a second collection location downstream of the first collection location.

9. The agricultural article sizer according to claim 8 wherein the agricultural article sizer is configured to direct agricultural articles passing through the gap to the second collection location transversely to the conveying direction to one point of use.

10. The agricultural article sizer according to claim 7 wherein the agricultural article sizer comprises an endless chain and a drive for advancing the chain in an endless path, the plurality of rollers connected to the endless chain to follow movement of the endless chain in the endless path.

11. The agricultural article sizer according to claim 3 wherein with the third roller in the first relationship with the first roller, the third axis is at, or closely adjacent to, the plane containing the first and second axes.

12. The agricultural article sizer according to claim 1 wherein the first, second, and third peripheral surfaces of the rollers have diameters that are substantially the same.

13. An agricultural article sizer comprising:

a frame assembly;

a plurality of rollers on the frame assembly with substantially parallel lengthwise axes and through which agricultural articles are: a) advanced in a conveying direction transverse to the roller axes; and b) separated by size, the plurality of rollers comprising first and second rollers with first and second axes and first and second peripheral surfaces and a third roller with a third peripheral surface and a third axis between the first and second axes along the conveying direction, the third roller movable selectively relative to the first roller to change a spacing between the third axis and a plane containing the first and second axes to thereby change a dimension of a gap between the first and third peripheral surfaces to thereby allow passage through the gap of different selected ranges of agricultural article size to facilitate sorting of different sizes of agricultural articles, wherein the first, second, and third rollers each has axially spaced first and second ends, wherein the agricultural article sizer further comprises a first bracket to which the first ends of the third roller and only one of the first and second rollers are connected, wherein the third roller is movable to be in a first relationship with the first roller wherein the gap between the first and third peripheral surfaces has a first dimension to allow passage through the gap of agricultural articles less than or equal to a first size to a first collection location, wherein the third roller is movable to be in a second relationship with the first roller wherein the gap between the first and third peripheral surfaces has a second dimension that is greater than the first dimension to allow passage through the gap of agricultural articles less than or equal to a second size that is greater than the first size, wherein the agricultural article sizer has an upper article conveying length with an upstream end and a downstream end;

a roller guide system, the roller guide system cooperating with the plurality of rollers to cause the third roller to move from the first relationship with the first roller into the second relationship with the first roller as an incident of the third roller moving in the conveying direction towards the downstream end of the article conveyor length, an endless chain; and a drive for advancing the chain in an endless path, the plurality of rollers connected to the endless chain to follow movement of the endless chain in the endless path, wherein the roller guide system comprises the first bracket, the first end of the one of the first and second rollers is connected to the first bracket so that the axis of the one of the first and second rollers is fixed relative to the first bracket and the first bracket has a first elongate slot within which the first end of the third roller is guidingly movable to allow the third roller to change between the first and second relationship with the first roller.

14. The agricultural article sizer according to claim 13 wherein the first elongate slot is substantially straight and extends vertically with the third roller located along the upper article conveying length.

15. The agricultural article sizer according to claim 14 wherein the roller guide system further comprises a wheel at the first end of the third roller and a guide surface extending in the conveying direction, the wheel rolling against the guide surface as the rollers are advanced in the conveying direction, the guide surface configured so that as the wheel rolls against the guide surface, the third roller is caused to change between the first and second relationships with the first roller.

16. The agricultural article sizer according to claim 15 wherein the guide surface is configured to be reoriented to thereby change a travel path for the wheel as the chain moves in the endless path.

17. The agricultural article sizer according to claim 15 wherein the roller guide system comprises a wheel at the first end of each of the first and second rollers and a guide surface extending in the conveying direction against which the wheels on the first and second rollers roll as the rollers are advanced in the conveying direction.

18. The agricultural article sizer according to claim 13 further comprising a second bracket to which the other of the first and second rollers is connected, the first and second brackets movable independently, each from the other.

19. An agricultural article sizer comprising:

a frame assembly;

a plurality of rollers on the frame assembly with substantially parallel lengthwise axes and through which agricultural articles are: a) advanced in a conveying direction transverse to the roller axes; and b) separated by size, the plurality of rollers comprising first and second rollers with first and second axes and first and second peripheral surfaces and a third roller with a third peripheral surface and a third axis between the first and second axes along the conveying direction, the third roller movable selectively relative to the first roller to change a spacing between the third axis and a plane containing the first and second axes to thereby change a dimension of a gap between the first and third peripheral surfaces to thereby allow passage through the gap of different selected ranges of agricultural article size to facilitate sorting of different sizes of agricultural articles, wherein the first, second, and third rollers each has axially spaced first and second ends, wherein the agricultural article sizer further comprises a first bracket to which the first ends of the third roller and only one of the first and second rollers are connected, wherein the third roller is movable to be in a first relationship with the first roller wherein the gap between the first and third peripheral surfaces has a first dimension to allow passage through the gap of agricultural articles less than or equal to a first size to a first collection location, wherein the third roller is movable to be in a second relationship with the first roller wherein the gap between the first and third peripheral surfaces has a second dimension that is greater than the first dimension to allow passage through the gap of agricultural articles less than or equal to a second size that is greater than the first size, wherein the agricultural article sizer has an upper article conveying length with an upstream end and a downstream end; and a roller guide system, the roller guide system cooperating with the plurality of rollers to cause the third roller to move from the first relationship with the first roller into the second relationship with the first roller as an incident of the third roller moving in the conveying direction towards the downstream end of the article conveyor length, wherein with the third roller in the second relationship with the first roller, articles less than or equal to the second size pass through the gap to a second collection location downstream of the first collection location, wherein the agricultural article sizer is configured to direct agricultural articles passing through the gap to the second collection location transversely to the conveying direction to one point of use, wherein the agricultural article sizer is configured to receive agricultural articles that do not pass between rollers between the upstream and downstream ends of the upper article conveying length and that discharge at the downstream end of the upper article conveying length and direct the discharging articles to another point of use.

20. An agricultural article sizer comprising:

a frame assembly; and a plurality of rollers on the frame assembly with substantially parallel lengthwise axes and through which agricultural articles are: a) advanced in a conveying direction transverse to the roller axes; and b) separated by size, the plurality of rollers comprising first and second rollers with first and second axes and first and second peripheral surfaces and a third roller with a third peripheral surface and a third axis between the first and second axes along the conveying direction, the third roller movable selectively relative to the first roller to change a spacing between the third axis and a plane containing the first and second axes to thereby change a dimension of a gap between the first and third peripheral surfaces to thereby allow passage through the gap of different selected ranges of agricultural article size to facilitate sorting of different sizes of agricultural articles, wherein there is at least one repositionable flap that confines articles upon the rollers, the third roller acting against the at least one repositionable flap and repositioning the flap as an incident of the third roller moving relative to the first roller to change the spacing between the third axis and the plane containing the first and second axes.

21. An agricultural article sizer comprising:

a frame assembly; and a plurality of rollers on the frame assembly with substantially parallel lengthwise axes and through which agricultural articles are: a) advanced in a conveying direction transverse to the roller axes; and b) separated by size, the plurality of rollers comprising first and second rollers with first and second axes and first and second peripheral surfaces and a third roller with a third peripheral surface and a third axis between the first and second axes along the conveying direction, the third roller movable selectively relative to the first roller to change a spacing between the third axis and a plane containing the first and second axes to thereby change a dimension of a gap between the first and third peripheral surfaces to thereby allow passage through the gap of different selected ranges of agricultural article size to facilitate sorting of different sizes of agricultural articles, wherein the third roller is movable to be in a first relationship with the first roller wherein the gap between the first and third peripheral surfaces has a first dimension to allow passage through the gap of agricultural articles less than or equal to a first size to a first collection location, wherein the third roller is movable to be in a second relationship with the first roller wherein the gap between the first and third peripheral surfaces has a second dimension that is greater than the first dimension to allow passage through the gap of agricultural articles less than or equal to a second size that is greater than the first size, wherein the agricultural article sizer has an upper article conveying length with an upstream end and a downstream end and further comprises a roller guide system, the roller guide system cooperating with the plurality of rollers to cause the third roller to move from the first relationship with the first roller into the second relationship with the first roller as an incident of the third roller moving in the conveying direction towards the downstream end of the article conveyor length, wherein the first, second, and third rollers each has axially spaced first and second ends and the roller guide system further comprises a first bracket to which the first ends of the third roller and only one of the first and second rollers is connected, the first end of the one of the first and second rollers connected to the first bracket so that the axis of the one of the first and second rollers is fixed relative to the first bracket and the first bracket has a first elongate slot within which the first end of the third roller is guidingly movable to allow the third roller to change between the first and second relationship with the first roller.

22. An agricultural article sizer comprising:

a frame assembly; and a plurality of rollers on the frame assembly with substantially parallel lengthwise axes and through which agricultural articles are: a) advanced in a conveying direction transverse to the roller axes; and b) separated by size, the plurality of rollers comprising first and second rollers with first and second axes and first and second peripheral surfaces and a third roller with a third peripheral surface and a third axis between the first and second axes along the conveying direction, the third roller movable selectively relative to the first roller to change a spacing between the third axis and a plane containing the first and second axes to thereby change a dimension of a gap between the first and third peripheral surfaces to thereby allow passage through the gap of different selected ranges of agricultural article size to facilitate sorting of different sizes of agricultural articles, wherein the first, second, and third rollers each has axially spaced first and second ends, wherein the agricultural article sizer further comprises a first bracket to which the first ends of the third roller and one of the first and second rollers are directly connected, wherein the agricultural article sizer comprises an endless chain and a drive for advancing the chain in an endless path, the plurality of rollers connected to the endless chain to follow movement of the endless chain in the endless path, the endless chain separate from and connected to the first bracket.

23. The agricultural article sizer according to claim 22 wherein the agricultural sizer further comprises another bracket to which the second ends of the third roller and the one of the first and second rollers are directly connected and the endless chain is separate from and configured to drive each of the first and the another bracket.

* * * * *